United States Patent [19]

Kresmery

[11] Patent Number: 4,765,439

[45] Date of Patent: Aug. 23, 1988

[54] LADDER RETAINING DEVICE AND METHOD FOR USING SAME

[76] Inventor: Robert C. Kresmery, 55222 Washington Dr., Rochester, Mich. 48064

[21] Appl. No.: 53,275

[22] Filed: May 22, 1987

[51] Int. Cl.[4] ..... E06C 7/48

[52] U.S. Cl. ..... 182/107; 182/214; 182/206

[58] Field of Search ..... 182/206, 214, 107, 150; 248/210, 211, 238

[56] References Cited

U.S. PATENT DOCUMENTS

| | | | |
|---|---|---|---|
| 972,001 | 10/1910 | Holdorf | 182/214 |
| 2,680,554 | 6/1954 | Dakin | 182/214 |
| 2,685,957 | 8/1954 | Schlesinger | 182/206 |
| 2,722,360 | 11/1955 | Malm . | |
| 2,854,292 | 9/1958 | Schaeffer | 182/206 |
| 3,268,196 | 8/1966 | Anton | 182/206 |
| 4,276,957 | 7/1981 | Kilgore | 182/206 |
| 4,339,020 | 7/1982 | Wiseman | 182/214 |
| 4,388,983 | 6/1983 | Bartels et al. . | |
| 4,394,887 | 7/1983 | Spinks | 182/214 |

*Primary Examiner*—Reinaldo P. Machado
*Attorney, Agent, or Firm*—Brooks & Kushman

[57] ABSTRACT

A device for retaining the upper end of a ladder to a building parapet wall or the like to securely, temporarily hold the ladder. The device is provided with a frame which is temporarily attached to the ladder and projects outwardly therefrom to extend over the building parapet wall. A clamp is attachable to the frame in various positions to entrap the parapet wall between the clamp and the ladder preventing a relative movement thereof.

17 Claims, 1 Drawing Sheet

LADDER RETAINING DEVICE AND METHOD FOR USING SAME

FIELD OF INVENTION

This invention relates to ladder retaining devices and more specifically to retaining devices intended to fasten the upper end of a ladder to a building parapet wall or the like.

BACKGROUND OF INVENTION

When using a ladder to scale a building, it is quite important to position the ladder securely so that the ladder does not move or fall resulting in injury to the user. It is for this reason that commercial construction which is regulated by the Occupational Safety and Health Administration (OSHA) requires that the upper end of the ladder be secured to the building against which it is rested. While there have been previous attempts to develop ladder retaining devices, as shown in U.S. Pat. Nos. 1,374,060, 1,982,572, 3,853,202 and 4,444,291, there remains a definite need for a simple, reliable retaining device to secure a ladder to a building, particularly, flat top commercial buildings having parapet walls and no external guarders.

OBJECTS, FEATURES & ADVANTAGES OF INVENTION

An object of the present invention is to provide a simple, reliable retaining device for attaching a ladder to a building parapet wall.

Another object of the invention is to provide a ladder retaining device which is capable of being installed on a wide variety of existing ladders and buildings.

A feature of the present invention is its ability to adapt to retain a wide variety of ladders to buildings having varying parapet wall thicknesses, and varying ladder to building angular relationships.

An advantage of the present invention is the device's simplicity and ability to retain a ladder securely with a lightweight device.

Another advantage of the present invention is the simplicity and versatility the method of retaining a ladder to a building wall can be carried out without any damage to the building structure.

These advantages and other objects and features of a ladder retaining device and method for using same are more fully described in the accompanying drawings and specification.

SUMMARY OF INVENTION

The present invention is directed to a ladder retaining device and method for using same. The ladder retaining device is used for temporarily attaching the upper end of a ladder to a building parapet wall or the like. The device includes a frame which is temporarily attached to a ladder in a manner to project outwardly therefrom to extend over the building parapet wall. The device also includes a clamp means attachable to the frame at various positions to securely entrap the parapet wall between the clamp means and the ladder, preventing the relative movement thereof.

The method of using the ladder retaining device includes steps of providing a ladder having a length in excess of the height of the building to be scaled, and providing a ladder retaining device of the type generally described previously. The ladder is inclined against the building so that the top of the ladder extends above the parapet wall. The ladder retaining device is telescopically slid over the top end of the ladder and positioned against the top of the building wall extending generally horizontally and extending over the wall. A clamp means is then affixed to the retaining device so that the clamp engages the wall and entraps the wall between the clamp and the ladder.

BRIEF DESCRIPTION OF PREFERRED EMBODIMENT

Figure 1:
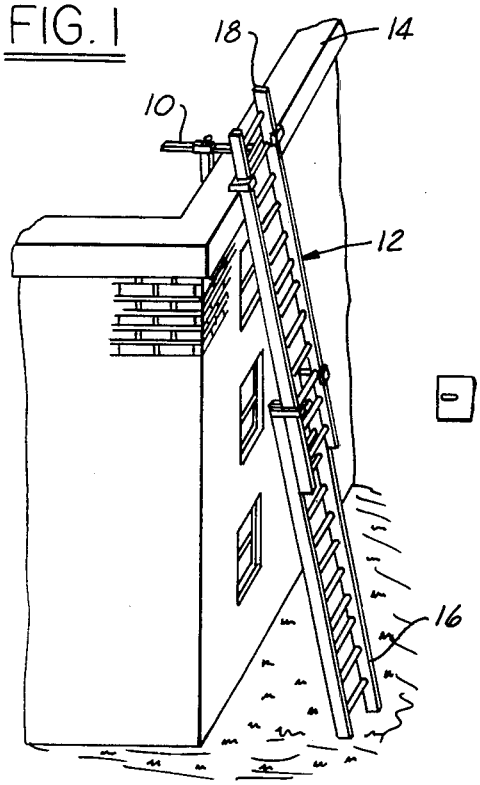
FIG. 1 is a perspective view of a ladder retaining device of the present invention shown affixed to a ladder and a building wall.

With reference to the drawings, one preferred embodiment of the invention will be described in detail. The ladder retainer 10 is shown in FIG. 1 securing a ladder 12 to building parapet wall 14. Ladder 12 has two ends, lower end 16 resting on the ground, and an upper end 18 which extends above the parapet wall 14. The lower end of the ladder engages the ground in a spaced apart distance from the building so that the ladder leans against the building in an inclined manner. The ladder contacts the building preferably 3 or 4 feet from the ladder's upper end 18. Having the ladder extend above the parapet wall by a distance of 3 or 4 feet enables the user of the ladder to grasp the top rungs of the ladder when climbing on or off the building roof.

Figure 2:
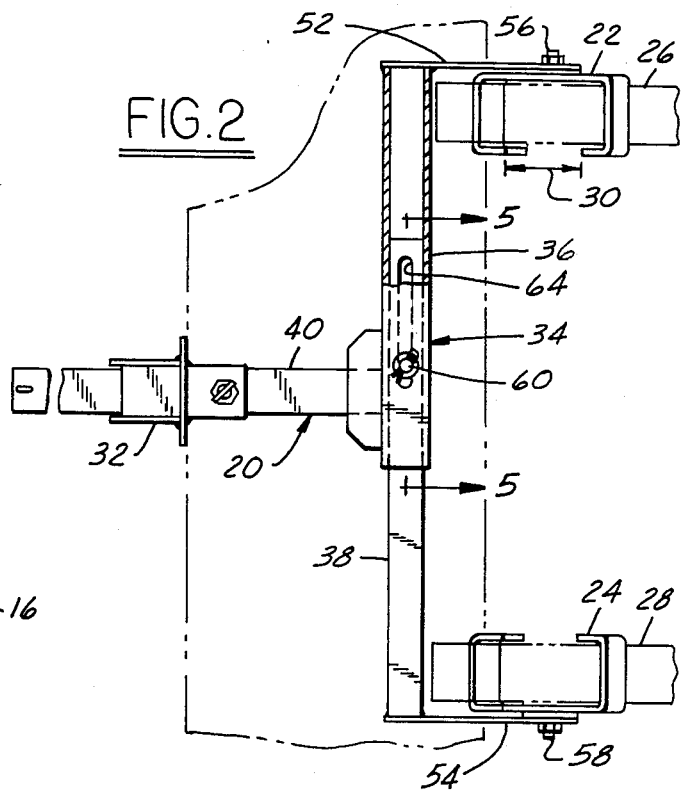
FIG. 2 is an enlarged plane view of the retaining device with the building and ladder shown in phantom outline.
Figure 4:
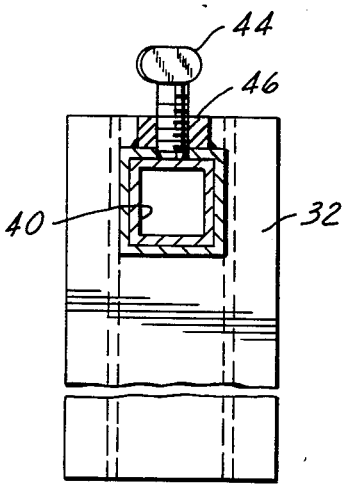
FIG. 4 is an enlarged cross-sectional view taken along line 4—4 of FIG. 3.

An enlarged plane view of the ladder retainer 10 is shown in FIG. 2. The ladder retainer includes frame 20, and a pair of generally C-shaped channel sections 22 and 24 which are pivotably attached to the frame and sized to telescopically fit over the rails of the ladder 26 and 28. Each of the C-shaped channel sections has an opening 30 formed therein to allow adequate clearance for the rungs of the ladder to pass therethrough as the assembly is slid down the ladder.

The retaining device also includes a clamp arm 32 which is fastenable to the frame at various positions to provide means for securely attaching the ladder retaining device and ladder to the parapet wall. Frame 20 as depicted in the preferred embodiment is generally T-shaped having a generally horizontal transverse member 34 having two ends, each of which is oriented generally adjacent opposite rails of the ladder. Transverse member 34 is preferably formed of first and second members 36 and 38 which telescopically engage one another to enable the effective length of the transverse member 34 to be varied to correspond to the varying spacing of the ladder rails.

Frame 20 also includes a horizontal member 40 affixed at one end to transverse member 34 and projecting outwardly from same to extend over and across the building parapet wall 14. Slidably attached to horizontal member 40 is clamp arm 32 which can be shifted along horizontal member 40 through a limited range which is sufficient to accommodate most commonly existing parapet walls. It should be recognized that the length of the horizontal member 40 can vary depending upon the maximum range of parapet wall thicknesses thought desirable. Since most parapet walls are less than two feet in thickness in modern buildings, a three foot long horizontal member is generally more than adequate.

Horizontal member 40 is provided with a cotter pin 42 which serves as a stop means to limit the travel of the clamp relative to the horizontal member and to prevent detachment thereof. In order to fasten the clamp 32 at the desired position on the horizontal member 40 the device is provided with a threaded fastener 44 which provides a fastening means to temporarily securely attach the clamp arm to the horizontal member. Threaded fastener 44 extends through, and cooperates with, a threaded nut 46 which is welded to a portion of clamp arm 32 which telescopically engages horizontal member 40. When tightened, the end of threaded fastener 44 engages horizontal member 40 to securely retain clamp arm 32 securely affixed to horizontal member 40.

Figure 3:
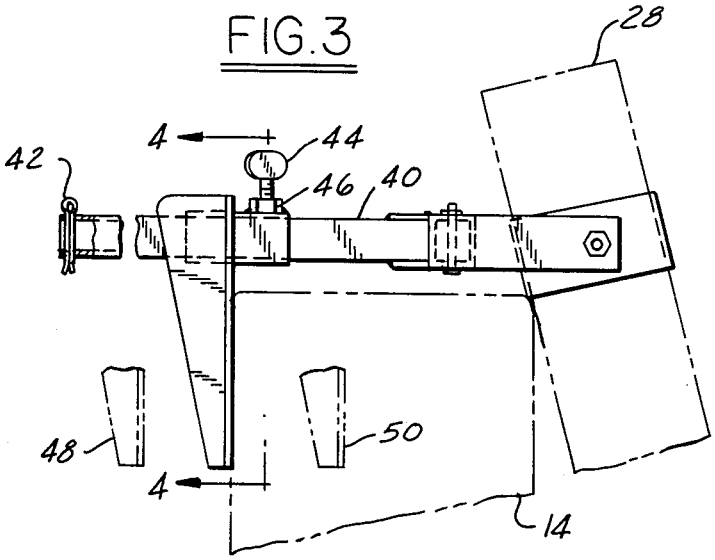
FIG. 3 is a side elevation of the device shown in FIG. 2.
Figure 5:
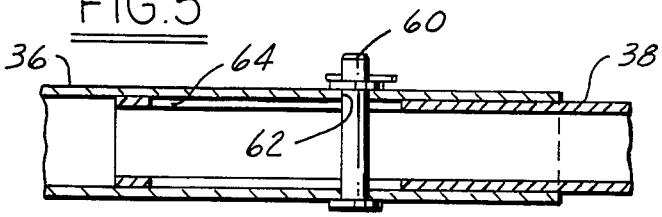
FIG. 5 is an enlarged cross-sectional view taken along line 5—5 of FIG. 2.

In FIG. 3 the retaining device is shown securing ladder 10 to parapet wall 14. Clamp 32 is positioned firmly against the parapet wall generally retaining the parapet wall between ladder 10 and clamp arm 32. Alternative positions of clamp arm 32 are shown in phantom outline 48 and 50 to depict the orientation of clamp arm 32 in the case of a thicker or thinner parapet wall.

C-shaped channel sections 22 and 24 are affixed to opposite ends of transverse member 34 by mounting brackets 52 and 54 welded to opposite ends of transverse member. The C-shaped channel sections are pivotably attached to mounting brackets 52 and 54 by pivot members 56 and 58 which is provided by a bolt, rivet or the like. Brackets 52 and 54 provide sufficient distance between the transverse member and the pivot points to enable the C-shaped channel sections to rotate freely.

As previously described the transverse member 34 is made up of a first and second member 36 and 38 which telescopically cooperate with one another. Pin 60 extends through a hole and a slot 62 and 64 which extend through a first and second member respectively and limit the relative telescopic movement therebetween. Pin 60 prevents the first and second member from becoming separated and maintains sufficient telescopic engagement to provide adequate strength. The entire device is preferably fabricated using metal tubing and formed sheet metal sections. For corrosion resistance and weight, aluminum may be used, however, cold rolled steel with a painted exterior surface works quite satisfactorily and it is very easy to weld. It should also be noted that the device could be made of an alternative material such as plastic or the like, however, steel and aluminum are preferred for typical applications.

The present invention also relates to the method of temporarily attaching a ladder to a building parapet wall or the like. The method includes the step of providing a ladder having a length in excess of the height of the building parapet wall. The next step is the providing of a ladder retaining device which is telescopically attachable to the rails of the ladder and has a frame for extending over the parapet walls, and a clamp member attachable to the frame at various positions. The ladder is placed against the building wall in an inclined manner so that the upper end of the ladder extends above the parapet wall. The retaining device is telescopically slid over the ladder rails to rest the device on the parapet wall. The retaining device clamp is then positioned adjacent the parapet wall and fastened in place to entrap the parapet wall between the ladder and the retaining device clamp to prevent relative movement between the ladder and the parapet wall.

It will be understood, of course, that while the form of the invention herein shown and described constitutes a preferred embodiment of the invention, it is not intended to illustrate all possible forms thereof. It will also be understood that the words used are words of description rather than of limitation, and the various changes may be made without departing from the spirit and scope of the invention disclosed.

I claim:

1. A ladder retaining device for temporarily attaching the upper end of a ladder having a pair of spaced apart longitudinal rails to a building parapet wall or the like, said device comprising:

a frame;

means to temporarily attach the frame to the rails of the ladder to cause the frame to project generally horizontally outwardly therefrom to overhang the building parapet wall; and clamp means to temporarily retain the frame to the building parapet wall, said clamp means fastenable to the frame at various positions to allow the ladder to be securely affixed to parapet walls of varying thicknesses.

2. The invention of claim 1 wherein the attachment means further comprise a pair of generally C-shaped channels affixed to the frame in spaced apart relation, each of said channels being sized to securely entrap and telescopically slide over a ladder rail.

3. The invention of claim 2 wherein said C-shaped channels are pivotably affixed to said frame.

4. The invention of claim 2 wherein said invention further comprises means to adjust the relative spacing between said C-shaped channels to accommodate the varying spacing between the longitudinal rails of the ladder.

5. The invention of claim 1 wherein said frame further comprises a transverse member having two ends extending generally between the rails of the ladder, and an outwardly projecting horizontal member attached to said transverse member for extending over the parapet wall.

6. The invention of claim 5 wherein said attachment means further comprise a pair of C-shaped channels pivotably attached to opposite ends of the frame transverse member, said C-shaped channels sized to telescopically fit over the rails of the ladder.

7. The invention of claim 6 wherein said transverse member further comprises a first and second member further comprises a first and second member telescopically cooperating with one another to enable the relative spacing between the C-shaped channels attached thereto to be freely varied within a limited range to accommodate various ladder rail spacings.

8. The invention of claim 5 wherein said clamp means further comprises of an arm having two ends, one end slotably attached to the frame horizontal member, and the other end projecting outwardly therefrom in a cantilevered matter for engagement with the building parapet wall.

9. The invention of claim 8 further comprising fastener means for temporarily fastening the arm to the horizontal member at various positions corresponding to parapet wall thickness.

10. The invention of claim 9 further comprising stop means to limit the slidable travel of the arm relative to the frame horizontal member to prevent the separation thereof.

11. A ladder retaining device for temporarily attaching the upper end of a ladder having pair of spaced apart longitudinal rails to a building parapet wall or the like, said device comprising:

a substantially horizontal T-shaped frame, further comprising a transverse member having two ends extending generally between the rails of the ladder and an outwardly projecting horizontal member attached to said transverse member for overhanging the parapet wall;

a pair of generally C-shaped channels affixed to opposite ends of the frame transverse member, each of said channels being sized to securely entrap, yet telescopically slide over, a ladder rail to temporarily attach the frame thereto;

a clamp arm slidably cooperating with the frame horizontal member projecting generally downwardly therefrom for engagement with the building parapet wall; and fastening means for temporarily attaching the clamp arm to the horizontal member to securely entrap the parapet wall between the rails of the ladder and the clamp arm.

12. The invention of claim 11 further comprising stop means to limit the travel of the clamp arm relative to the horizontal frame member to prevent the separation of same.

13. The invention of claim 11 wherein said C-shaped channels are pivotably attached to said frame transverse member.

14. The invention of claim 11 further comprising freely vary the relative spacing between the C-shaped channels to accommodate varying ladder rail spacing.

15. The invention of claim 11 wherein said frame transverse member further comprises a first and second member telescopically cooperating with freely to vary the relative spacing between the C-shaped channels attached to the ends thereof.

16. The invention of claim 11 wherein said C-shaped channels are pivotably attached to the first and second members to enable the frame to be maintained generally horizontal irrespective of the ladder angle.

17. A method of temporarily attaching a ladder having a pair of spaced apart longitudinal rails to a building parapet wall or the like comprising of the following steps:

providing a ladder having a length in excess of the height of the building parapet wall;

providing a ladder retaining device telescopically attachable to the rails of the ladder, and having a frame member for extending over the parapet wall and a clamp member attachable to said frame at various positions;

placing the ladder against the building in an inclined manned so that the upper end of the ladder extends above the parapet wall;

telescopically sliding the ladder retaining device over the top of the ladder to horizontally rest said frame upon the parapet wall; and positioning the retaining device clamp adjacent the parapet wall and fastening the clamp to the frame to entrap the parapet wall between the ladder rails and the retaining device clamp.

* * * * *

UNITED STATES PATENT AND TRADEMARK OFFICE

CERTIFICATE OF CORRECTION

PATENT NO. : 4,765,439

DATED : August 23, 1988

INVENTOR(S) : Robert C. Kresmery

It is certified that error appears in the above-identified patent and that said Letters Patent is hereby corrected as shown below:

In claim 7, column 4, line 54, please delete the phrase "further comprises a first and second member".

In claim 11, column 5, line 6, immediately following the word "having", please insert the word ---a---.

In claim 14, column 6, line 1, immediately following the word "comprising", please insert the phrase ---means to---.

In claim 15, column 6, line 6, immediately following the phrase "cooperating with", please insert the phrase ---one another to---.

In claim 15, column 6, line 6, immediately following the word "freely", please delete the word "to".

In claim 17, column 6, line 25, please delete the word "manned", and insert in its place the word ---manner---.

Signed and Sealed this

Sixteenth Day of May, 1989

*Attest:*

*Attesting Officer*

DONALD J. QUIGG

*Commissioner of Patents and Trademarks*